US005330798A

United States Patent [19]

Browning

[11] Patent Number: 5,330,798

[45] **Date of Patent: * Jul. 19, 1994**

[54] THERMAL SPRAY METHOD AND APPARATUS FOR OPTIMIZING FLAME JET TEMPERATURE

[75] Inventor: James A. Browning, Enfield, N.H.

[73] Assignee: Browning Thermal Systems, Inc., Enfield, N.H.

[ * ] Notice: The portion of the term of this patent subsequent to Dec. 21, 2010 has been disclaimed.

[21] Appl. No.: 987,818

[22] Filed: Dec. 9, 1992

[51] Int. Cl.[5] ..... B05D 1/10

[52] U.S. Cl. ..... 427/446; 239/79

[58] Field of Search ..... 427/446; 239/79, 80, 239/82, 83, 85

[56] References Cited

U.S. PATENT DOCUMENTS

| | | | |
|---|---|---|---|
| 2,861,900 | 11/1958 | Smith et al. | 427/446 |
| 4,235,943 | 11/1980 | McComas et al. | 427/446 |
| 4,256,779 | 3/1981 | Sokol et al. | 427/446 |
| 5,014,915 | 5/1991 | Simm et al. | 239/79 |
| 5,120,582 | 6/1992 | Browning | 239/79 |
| 5,271,965 | 12/1993 | Browning | 427/446 |

*Primary Examiner*—Shrive Beck
*Assistant Examiner*—Katherine A. Bareford
*Attorney, Agent, or Firm*—Sughrue, Mion, Zinn, Macpeak & Seas

[57] ABSTRACT

An internal burner combusting an oxy-fuel or air-fuel mixture, or a plasma heat source providing a supersonic flame jet which when expanded to atmospheric or lower pressure is characterized by a static temperature well above the melting point of a material in particle form being sprayed by the flame jet and the step of reducing the flame jet temperature after reaching supersonic velocity to a temperature below the melting point of the material prior to feeding of the material particles into the flame jet. The jet temperature reduction may be effected by injecting directly into the flame jet stream an amount of liquid or gas fluid which will reduce the flame jet temperature by the required amount. Alternatively, the supersonic flame jet may be passed through a concentric heat exchanger bearing a coolant medium such as water to absorb the necessary amount of heat from the flame jet to reduce the flame jet temperature to below the melting point of the material.

8 Claims, 1 Drawing Sheet

THERMAL SPRAY METHOD AND APPARATUS FOR OPTIMIZING FLAME JET TEMPERATURE

FIELD OF THE INVENTION

The present invention is directed to an internal burner for thermal spraying of powdered material by a supersonic flame jet from an oxy-fuel, or air-fuel mixture combusted in a combustion chamber of an internal burner and expanded to atmospheric or lower pressure through a nozzle coupled to the internal burner combustion chamber, or from a plasma heat source, and more particularly to lowering of the jet temperature to below the melting point of the material being sprayed such that the material is rendered solid prior to impact on a substrate or workpiece with an appreciable temperature increase corresponding to the kinetic energy expended by the high velocity particles impacting on the surface of the substrate or workpiece to effect particle fusion.

BACKGROUND OF THE INVENTION

It is known from U.S. Pat. No. 2,861,900, issued Nov. 25, 1958, entitled "JET PLATING OF HIGH MELTING POINT MATERIALS", that particles can be heated to high temperatures by being entrained in the combusting mixture and in the jet flame with an appreciable temperature increase corresponding to the kinetic energy expended upon the impact of the high velocity particles upon the surface of the workpiece to be coated sufficient to ensure a firm mechanical bond with the surface of the workpiece.

In my U.S. Pat. No. 5,120,582, issued Jun. 9, 1992, entitled "MAXIMUM COMBUSTION ENERGY CONVERSION AIR FUEL INTERNAL BURNER" and in my U.S. Pat. No. 5,271,965 entitled "THERMAL SPRAY METHOD UTILIZING IN-TRANSIT POWDER PARTICLE TEMPERATURES BELOW THEIR MELTING POINT", unlike U.S. Pat. No. 2,861,900, the particles are fed into the jet stream downstream of the throat of an elongated expansion nozzle having a L/D ratio of least 3:1 to prevent clogging of the nozzle bore.

In U.S. Pat. No. 5,271,965 there is particular emphasis on impact fusion, i.e. the method of producing a coating by impacting high-velocity solid (plastic) particles against the surface in which the released impact energy raises the particles to their melting point. In that application, it is noted that "impact fusion" is best carried out by injection of the powder being sprayed into a supersonic jet stream of a static temperature less than that of the melting point of the powder being sprayed. For example, operating an oxy-fuel internal burner at a combustion pressure of 300 psig produces a 6,700 ft/sec jet with a static temperature of 2,750° F. For powdered materials of high melting point, the criterion for "impact fusion" is met. But, for a metal such as aluminum with a melting point of about 1,200° F., particle melting limits the accelerating nozzle length to less than that required to reach maximum particle velocity. However, my U.S. Pat. No. 5,120,582 teaches in certain examples that combustion pressure increases may be achieved in a simple manner using compressed air and fuel oil in place of propane such that, for a combustion pressure of 1,200 psig, the supersonic jet stream reach fully expended velocities in the range of Mach 4.5 (7,400 ft/sec). Such leads to particle impact velocities on substrates of over 4,000 ft/sec, and the coatings on the substrate improve in quality nearly directly proportional to impact velocity.

SUMMARY OF THE INVENTION

It is therefore a primary object of the present invention to provide a thermal spray method which optimizes the flame jet temperature, particularly useful for low melting point particles such as aluminum to reach maximum particle velocity, but to reduce the jet temperature to its desired value below the melting point of the particles by cooling the supersonic jet to the point where particle melting is avoided.

This invention is directed to a method of particle coating of a substrate by impact fusion thermal spraying of a powdered material by a supersonic flame jet from an oxy-fuel, air-fuel or plasma heat source and expanding the flame jet to atmospheric or lower pressure and to the improvement of lowering the jet temperature to below that of the melting point of the material to ensure that the particles of material at the moment of impact on the substrate are below their plastic temperature. The step of reducing the temperature of the jet stream to a temperature below the melting point of said material may consist in injecting directly into the jet stream an amount of liquid coolant capable of reducing the jet stream temperature by the required amount or passing the jet through a heat exchanger capable of removing the necessary amount of heat from the jet to a coolant medium circulated through the heat exchanger. Preferably, the coolant medium is water.

DESCRIPTION OF THE PREFERRED EMBODIMENTS

Figure 1:
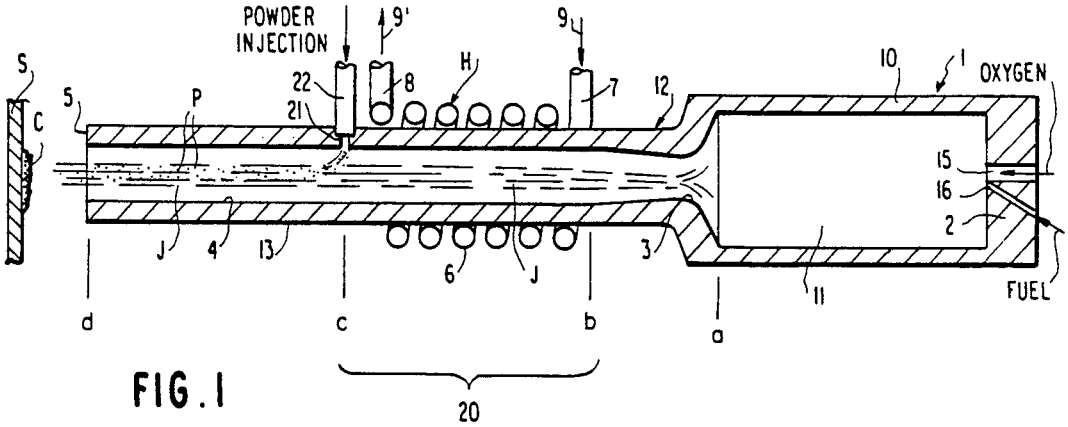
FIG. 1 is a schematic, longitudinal sectional view of an internal burner utilizing a jet cooling method forming a preferred embodiment of the invention.

An understanding of the present invention may be obtained by reference to FIG. 1, which is a longitudinal, cross-sectional view of an internal burner providing a high temperature flame jet capable of thermal spraying of material in particle form against a substrate S. The flame spray apparatus indicated generally at 1 is principally formed by a burner body 10 of elongated cylindrical form, which is integrated to an expanding nozzle 12 and an elongated nozzle extension 13. The components 10, 12 and 13 may constitute a unitary structure, the body 10 being of larger diameter than the expanding nozzle 12 and its nozzle extension 13. The body 10 includes an upstream end wall 2 and forms a combustion chamber 11. Oxygen and fuel identified schematically by labeled arrows are introduced to the combustion chamber 11 through intersecting oxygen and fuel injection passages 15 and 16, respectively, within end wall 2. Ignition in the combustion chamber 11 may be effected by a spark plug (not shown) or flashback from outlet 5 of nozzle passage or bore 4. The products of combustion as gas begin to expand at point a, FIG. 1, the entrance to nozzle 12 and upstream of throat 3. Full expansion with the formation of the supersonic gas flow takes place at point b.

The present invention is particularly involved with the step of cooling of the supersonic gas stream from point b to point c, which constitutes a flame jet cooling zone for the flame jet, indicated generally at J. The nozzle extension 13 is provided with a small diameter radial hole or bore 21 through which a low melting temperature material such as aluminum is introduced via a powder feed tube 22 from a source of powder as indicated by the arrow labeled "POWDER INJECTION". The particles of the low temperature melting material such aluminum enter the jet stream J and flow therewith, generally axially within bore 4 of the nozzle extension 13, as indicated at P. It is noted that the powder injection occurs downstream of the jet cooling zone which terminates at c, and the nozzle exit 5 is located at d, some distance downstream from the termination of the jet cooling zone at c.

The particles P, which are maintained at a temperature below their molten state, partially by the expansion of the gases and principally by the effect of cool down of the jet stream within jet cooling zone 20, impact against the substrate S to form coating C by impact fusion. The in-transit temperature of the particles to the workpiece is held below that melting point, while the jet stream itself supplies sufficient velocity to the particles such that upon striking the workpiece or substrate S, the impact energy is transformed into heat, thereby increasing the temperature of the particles to the fusion temperature of the particles and fusing the powdered material P to form a dense coating C on the workpiece surface. The particle are to be accelerated to supersonic velocity by being sprayed into the flame jet.

Such apparatus and the method steps described in general, to this point is exemplified by U.S. Pat. Nos. 2,861,900; 5,120,582 and 5,271,965.

The improvement within such method involves in the embodiment of FIG. 1 the cooling of the jet within cooling zone 20. Such cooling is effected in this embodiment by a simple heat exchanger indicated generally at H and comprised of a heat conducting tube 6, which is coiled about and in close contact with the outer periphery of the extension nozzle 13 over an axial length from b to c. The heat exchange coil 6 has an upstream inlet end 7 and a downstream outlet end 8, and a stream of liquid coolant such as water, schematically illustrated at 9, is fed into the inlet end 8 of the heat exchange tube coil 6 and exits as indicated schematically by arrow 9', the effect of which is to remove heat from the jet stream J over the full length of the heat exchanger H.

Figure 2:
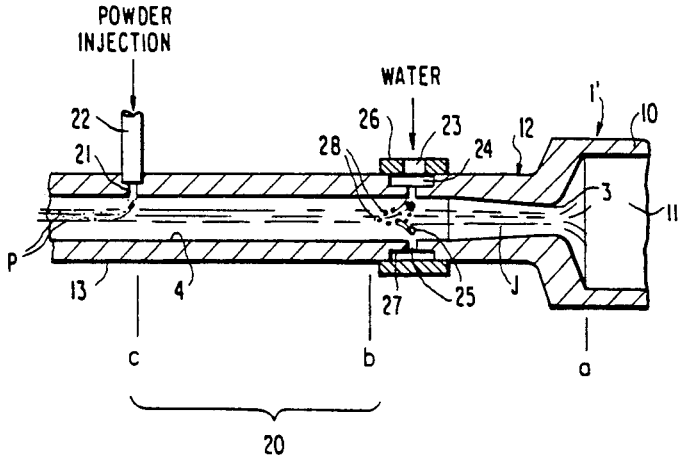
FIG. 2 is a schematic, longitudinal sectional view of an internal burner utilizing a method for cooling the flame jet by liquid injection into the hot jet gases and forming an alternate embodiment of the invention.

A second embodiment of the invention as shown in FIG. 2, in which the flame jet apparatus indicated generally at 1', is essentially the same as in the first embodiment with the exception of the structure employed in the flame jet cooling step, such constitutes an improvement in flame spraying of particles. Like elements in FIGS. 1 and 2 bear like numerals.

In FIG. 2, while only the downstream portion of body 10 is illustrated and only the upstream portion of nozzle extension 13 is shown, the content of that apparatus which is not shown is identical to that of FIG. 1, and a substrate or workpiece S, such as at FIG. 1, is positioned downstream of the outlet of the nozzle extension 13. In this embodiment, the products of combustion within combustion chamber 11 of body 10, effected by ignition of an oxygen and fuel mixture or air-fuel mixture as in FIG. 1, exit through the expansion nozzle 12 converging at nozzle throat 3. Gas expansion begins at point a, with full expansion and the formation of supersonic gas flow of the jet J taking place at point b, or upstream thereof. Similar to the embodiment of FIG. 1, cooling is effected in a jet cooling zone 20 between points b, c. Further, powder injection is downstream of the jet cooling zone at point c with powder injection by way of the labeled arrow and the particles passing through tube 22 and a small diameter radial hole 21 so as to enter and mix with the jet stream J, the particles being at P identical to that of the embodiment of FIG. 1. In this embodiment, jet cooling is effected differently from that of the embodiment of FIG. 1. The apparatus 1' further includes a ring 26 about the outer periphery of the nozzle extension 13 which acts in conjunction with a peripheral groove 27 having an axial length less than the width of ring 26 to form an annular manifold 24. A radial hole 23 within the ring 26 forms a liquid coolant inlet passage to which a liquid such as water as indicated schematically by the arrow labeled "WATER" is fed into the manifold. A plurality of circumferentially spaced small diameter radial holes 25 are provided within the nozzle extension 13 and open up at opposite ends to the manifold 24 and the bore 4 of the nozzle extension 13 forming a part of the nozzle passage of the two-segment nozzle assembly 12, 13. Water passes radially from the water inlet passage 23 into the annular manifold 24 and radially through the small diameter injector holes 25 such that the water is injected into the supersonic jet flow stream J exiting from the expansion nozzle 12. Liquid coolant as droplets 28 disappear prior to reaching the end of the coolant zone 20 at c. The liquid coolant, preferably water, is changed to steam. It is preferred that the powder injection via tube 22 and small diameter powder injection port 21 be downstream of the point c where most of the water has changed to steam.

Figure 3:
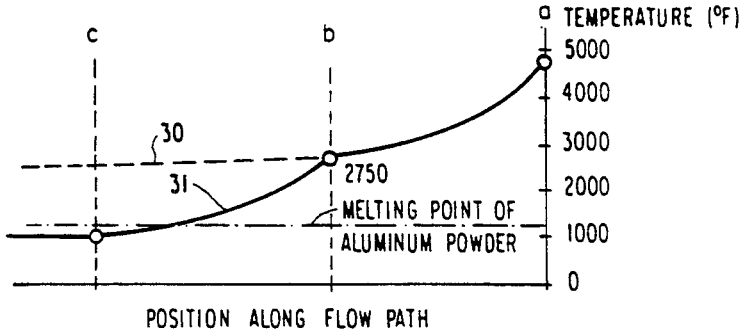
FIG. 3 is a plot of the jet stream along the flow path within the nozzle between the combustion chamber of the internal burner and the point particle feed into the jet stream of the embodiment of FIG. 2.

FIG. 3 is a plot illustrating the drop in temperature from the temperature of the products of combustion of the oxygen and fuel mixture or air-fuel mixture within combustion chamber 11 at the point a where they enter the expansion nozzle 12 and prior to reaching the throat 3 of the nozzle 12 for both the embodiments of FIGS. 1 and 2. The temperature on the plot, for the example given, is just below 5,000° F., at point a. The expansion of the combustion gases shows, in the plot, that the now supersonic jet stream temperature drops to 2,750° F. at the point b where the jet stream reaches the cooling zone 20. During passage through the cooling zone, the jet stream is reduced to a temperature below 1,000° F., some 200° F. below the melting point of the aluminum powder P, which powder P is injected into that jet stream via tube 22, in both embodiments. In the plot of FIG. 3, for the example given, the combustion chamber temperature is 4800° F., and the combustion pressure is 300 psig. The initial gas expansion curve from point a to point b, with a temperature drop from 4,800° F. to 2,750° F., results in a stream which is much too hot to impact fusion spray aluminum whose melting point is nearly 1,500° F. lower. The solid gas expansion curve line 31 plots the actual temperature of the jet stream as it passes through the cooling zone between points b, c, while the dash line 30 is a plot of the flame jet J temperature in the absence of water cooling.

The solid line gas expansion curve 31 is a plot of the flame jet gas temperature where, for the example given, the rate of coolant water injection via the injection ports 25 is 0.8 pounds per minute. As a result, the flame jet temperature falls to a value of approximately 900° F., which is several hundred degrees F below the aluminum melting point.

EXAMPLE I Parameters

Oxy-fuel combustion at 4,800° F. at a pressure of 300 psig.

1,800 scfh of oxygen 7 gallons per hour of fuel oil $T_j$, temperature of expanded jet=2,750° F. at b $V_j$, jet velocity=6,700 ft/sec at b combustion heat=700,000 Btu (after coolant heat losses)

assuming linear cooling relationship, a temperature reduction to 1,000° F. requires Q Btu absorption by the cooling water.

$$Q=WC_p\Delta T$$

Where W is weight flow of jet stream per unit time $C_p$ is the specific heat of these gases $\Delta T$ is the required temperature drop

Q=192 (0.24) (1,750)

=80,600 Btu/hr

Each pound of water requires approximately 1,000 Btu to reach the vaporized state. Thus, only 80 pounds of water are required per hour. This is 1⅓ pounds per minute.

While the description of the preferred embodiments illustrates two modes of cooling the jet flame prior to actual injection of the particles to be impact fused against the workpiece or substrate by a supersonic hot jet flame, the cooling of the jet flame may be accomplished by other methods. The disadvantages of external cooling requiring heat transfer through the nozzle extension 13 lies not only in the added complexity of the metal tubing in coil form or otherwise about the outer periphery of the nozzle extension 13, but the fact that appreciable heat is lost from the jet. Further, while the injected coolant is in liquid form, preferably water as illustrated in FIG. 2 for the second embodiment, any coolant may be employed capable of performing the function of adequately cooling the flame jet J over the extent of the cooling zone 20 including a compressed gas such as air. However, with water injection the total jet heat remains essentially constant with an increase in the jet mass flow.

It is envisioned additionally that cooling may be effected by the injection of a coolant stream through one or more inlet injector holes or ports 26 in accordance with the embodiment of FIG. 2, either radially as shown, or diagonally at a radially inward and downstream angle from a manifold such as manifold 24 by using a jet stream gaseous dilutant such as air or steam.

As may be appreciated in the embodiments of FIGS. 1 and 2, other liquids may be substituted for water, as long as they are capable of adequately removing heat from the supersonic jet stream or by vaporization therein, preferably upstream of the powder injection point C.

It should be understood that the new features of the flame spray apparatus for particle impact and fusion against the substrate as disclosed herein may be employed in ways and forms different from those of the preferred embodiments described above without departing form the spirit and scope of the invention, as defined by the appended claims.

What is claimed is:

1. In a method of thermal spraying of a powdered material by entrainment of particles of said powdered material in a supersonic flame jet from one of an oxy-fuel, air-fuel, or plasma heat source and expanding the flame jet to atmospheric or lower pressure characterized by a temperature above the melting point of the material being sprayed, the improvement comprising reducing the jet temperature after such expansion to below the melting point of the material prior to introduction of the material particles into said flame jet.

2. The method as claimed in claim 1, wherein said reduction in temperature of the flame jet is effected by injecting directly into the jet an amount of liquid which reduces said temperature to that below the melting point of said material.

3. The method as claimed in claim 2, wherein said step of injecting a liquid directly into the jet comprises injecting water.

4. The method as claimed in claim 1, wherein said step of reducing the temperature of the flame jet to a temperature below the melting point of said material comprises passing said flame jet through a concentric heat exchanger and transferring an amount of heat from the jet to a coolant medium within the heat exchanger sufficient to reduce the temperature of the flame jet to that below the melting point of said material.

5. The method as claimed in claim 4, wherein said step of passing said jet through a heat exchanger to transfer the heat from the jet to a coolant medium within the heat exchanger comprises transferring the heat from the flame jet to water flowing within said heat exchanger.

6. In a flame spray method using an internal burner having a body including a combustion chamber, said method comprises the steps of:

feeding a fuel and oxidizer mixture into said combustion chamber and igniting said fuel and oxidizer mixture to effect a combustion within said combustion chamber, expanding gaseous products of the combustion from a terminal face of the burner body through a restricting nozzle to form a flame jet which when expanded to atmospheric or lower pressure is characterized by a temperature above the melting point of a powder material to be sprayed into the flame jet to accelerate particles of said powder material to supersonic velocity, the improvement comprising:

reducing the jet temperature to below the melting point of the powder material prior to a point where a powder flow of material phase into the flame jet.

7. The method as claimed in claim 6, wherein the step of reducing the flame jet temperature to below the melting point of said material comprises injecting, directly into the expanded jet at a point upstream of the point of passing the powder flow of material in particle form into the jet, an amount of liquid which will reduce the temperature of the jet by a required amount to lower the flame jet temperature to that below the melting point of said material prior to entry of the particles of material into the jet.

8. The method as claimed in claim 6, wherein said step of reducing the flame jet temperature to below the melting point of said material prior to contact of the flame jet with the particles of material comprises passing said flame jet through a heat exchanger concentrically surrounding the flame jet and transferring necessary heat from the flame jet to a coolant medium circulating through said heat exchanger.

* * * * *